US006851471B2

(12) United States Patent
Barlow et al.

(10) Patent No.: US 6,851,471 B2
(45) Date of Patent: Feb. 8, 2005

(54) PERFORATING GUN

(75) Inventors: Darren R. Barlow, Mansfield, TX (US); Dennis R. Crowdis, Denton, TX (US); William J. Gilbert, Jr., Rio Vista, TX (US); Corbin S. Glenn, Benbrook, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/428,576

(22) Filed: May 2, 2003

(65) Prior Publication Data

US 2004/0216866 A1 Nov. 4, 2004

(51) Int. Cl.[7] ..... E21B 43/116

(52) U.S. Cl. ..... 166/55.2; 166/55; 102/307; 175/4.6

(58) Field of Search ..... 166/297, 55, 55.2; 102/307; 175/4.6

(56) References Cited

U.S. PATENT DOCUMENTS 2,649,046 A * 8/1953 Davis ..... 102/310
4,139,222 A * 2/1979 Loland ..... 285/27
4,583,602 A * 4/1986 Ayers ..... 175/4.52
4,753,301 A * 6/1988 Berry ..... 175/4.6
4,850,438 A * 7/1989 Regalbuto ..... 174/4.56
5,241,891 A * 9/1993 Hayes et al. ..... 89/1.15
5,598,891 A * 2/1997 Snider et al. ..... 166/308.1
5,603,379 A 2/1997 Henke et al. ..... 166/297
5,797,464 A * 8/1998 Pratt et al. ..... 175/4.6
5,816,343 A * 10/1998 Markel et al. ..... 175/4.51
6,006,833 A 12/1999 Burleson et al. ..... 166/250.08
6,220,355 B1 * 4/2001 French ..... 166/297
6,662,883 B2 12/2003 Bonkowski ..... 175/4.56
2003/0047358 A1 * 3/2003 Bonkowski ..... 175/4.6

* cited by examiner

*Primary Examiner*—David Bagnell
*Assistant Examiner*—Daniel P. Stephenson
(74) *Attorney, Agent, or Firm*—Michael W. Piper

(57) ABSTRACT

A perforating gun assembly useful in hydrocarbon well completion. The gun is assembled in a carrier made from straight walled tubing as a primary structural member with complementary male and female threads cut into opposite ends so that gun assemblies may be directly connected together. The male coupling includes a reinforcing sleeve threaded into an internal thread. An alignment pin is positioned in the carrier extending through the reinforcing ring and into the interior of the carrier. A charge assembly includes a charge holder tube with upper and lower alignment fixtures. The lower alignment fixture includes an alignment slot for mating with the alignment pin and a shoulder for supporting the charge assembly on the sleeve. The upper alignment fixture has an alignment pin for mating with an alignment slot in the carrier. A retainer ring may be threaded into the upper female threads to prevent removal of the charge assembly from the carrier.

50 Claims, 6 Drawing Sheets

PERFORATING GUN

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to perforating guns for use in hydrocarbon producing wells and more particularly to a perforating gun assembly made from straight wall tubing, having male and female couplings on opposite ends and a simple charge holder assembly.

BACKGROUND OF THE INVENTION

The completion of oil and gas wells by gun perforating is well known in the art. A work string including one or more perforating guns is lowered into a well casing cemented into the well bore. The perforating guns are positioned adjacent to the formation to be perforated. The perforating guns are fired to penetrate the casing and cement and form perforations into the producing formation for recovery of the desired fluids. These perforating guns typically utilize shaped charges to form the perforations.

Perforating guns are made in numerous configurations. One common type of prior art perforating gun is illustrated in FIGS. 1A and 1B. This prior art gun assembly is described in more detail in U.S. Pat. No. 6,006,833, which is assigned to the assignee of the present invention and which is hereby incorporated by reference for all purposes. The loaded gun assembly 10 is assembled in a hollow steel carrier 12 having female threads 14 and 16 cut into each end. The carrier 12 has gun ports, or thinned wall areas often referred to as scallops, 20 aligned with shaped charges 22 carried in the carrier 12. A charge holder 24 provides a frame for assembling the shaped charges 22 and connecting them with detonating cord 26. When the charge holder 24 is inserted in the carrier 12, the charge holder 24 holds the shaped charges 22 in alignment with the scallops 20. In this prior art system, the shaped charges 22 and scallops 20 are arranged in a helical configuration. The charge holder 24 normally is connected to an upper alignment fixture 28 and a lower alignment fixture 30 for positioning the charge holder 24 in the carrier 12 and some type of alignment means for aligning the shaped charges 22 with the gun ports 20. A snap ring 32 or other retainer means may be provided, especially with lower alignment fixture 30, to keep the charge holder 24 from sliding out of the bottom of carrier 12 as it is handled.

The threaded ends 14, 16 of the perforating gun carrier 12 are normally used to connect a perforating gun 10 into a work string for lowering the guns into a well. The gun carrier 12 forms part of the mechanical structure of the work string and must support the loads normally encountered in lowering a work string into a well and in removing it from a well. Normally, high strength connectors are provided to connect a perforating gun into a work string. One typical connector 34 has male threaded portions 36 on both ends and may be referred to as a tandem connector. A tandem connector 34 may be used, for example, to couple two standard perforating guns together to form a longer gun assembly. Another typical connector 38 has one male threaded end 40 and one female threaded end 42 and may be referred to as a box x pin connector. These connectors 34 and 38 must support full work string loads. They must also include interior passageways 44 and 46 with charge assemblies 48 and 50 for explosive transfer from initiating devices or from and to other gun assemblies connected above and below the perforating gun 10. The interior passageways 44 and 46 may be of small diameter to hold the detonating cord 26, leaving a thick strong wall to carry the required loads.

The complete gun assembly 10 includes carrier 12 with charge holder 24, shaped charges 22, upper and lower alignment fixtures 28 and 30, a tandem connector 34 on one end and a box x pin connector 52 on the other end. This assembly 10 includes an extension of the detonating cord 26 carried in interior passageways 44 and 46 in connecters 34 and 38 respectively and forming part of charge assemblies 48 and 50. The outermost ends of the connectors carry booster charges 54 and 56 coupled to the detonating cord 26 for explosive transfer to and from adjacent guns or from initiating devices. The connectors 34 and 38 provide good mechanical support for retaining charge holder 24 within the gun carrier and provide a means for connecting a plurality of guns together into a work string. However, in addition to the carrier 12 itself, the assembly 10 requires the extra connectors 34 and 38, each of which requires fluid tight seals, and the process of assembling the parts is fairly complicated and time consuming.

Thus, it would be desirable to provide a simple, easily assembled perforating gun assembly.

SUMMARY OF THE INVENTION

In one embodiment, a perforating gun includes a carrier made from straight wall tubing having a male coupling on one end and a female coupling in the other and adapted to be coupled directly to other like guns. In one embodiment, the couplings are formed by threads formed on the outer and inner surfaces of the tubing.

In one embodiment, the male coupling end also includes an internal thread having a length longer than the male coupling. An externally threaded sleeve is threaded into the internal thread and provides increased mechanical strength.

In one embodiment, an alignment pin is positioned in the male coupling end extending through the carrier and the sleeve and partially into the internal space within the sleeve. A first charge holder alignment fixture is sized to fit within the sleeve and engage the pin to align a charge holder with gun ports in the carrier. In an alternative embodiment, the pin may pass through only the carrier and sleeve to align the sleeve with the carrier, and a separate alignment pin or slot may be carried on or formed in the sleeve to provide alignment with a mating slot or pin on the charge holder alignment fixture.

In one embodiment, the first alignment fixture is coupled to a charge holder tube by pins and J-slots located to provide proper alignment of the charge holder tube within the carrier, when the first alignment fixture is aligned with the male coupling end.

In one embodiment, a second alignment fixture is also coupled to the charge holder tube with pins and J-slots. The second alignment fixture preferably carries an alignment pin or extension and the carrier preferably includes a mating internal slot. The pins and J-slots are preferably positioned so that when the charge holder assembly is inserted in the carrier with the second alignment fixture mated with the internal slot, the charge holder assembly is properly aligned with the carrier.

In one embodiment a retainer ring is provided for coupling with the carrier female coupling end and positively retaining the charge holder assembly within the carrier.

In another embodiment, a reverse external thread is provided on the carrier exterior adjacent the male coupling. A reverse threaded ring, which may act as a centralizer, may be used on the reverse thread to lock two gun assemblies according to the present invention at any relative rotational position allowing alignment of gun ports between adjacent guns.

In another embodiment, a set of gun port scallops is provided on one end of the carrier and positioned for mechanical manipulation of the perforating gun.

DETAILED DESCRIPTION OF THE PREFERRED EMBODIMENTS

For purposes of describing the present invention the relative location of various parts will be referred to as "upper", "lower", "above", and "below". These terms are intended to describe the relative position of a perforating gun in the vertical position normally used for assembling the gun into or as part of a drill string or work string for lowering into a borehole. Boreholes are normally essentially vertical at their surface location. Work strings and drill strings are normally connected together joint by joint or section by section at the borehole surface location as they are lowered into the borehole. While perforating guns are sometimes lowered into a borehole on a string of drill pipe, it is understood that perforating gun assemblies are not designed to withstand the torque normally encountered during drilling operations and would not be present during drilling operations. These terms are used for convenience in describing the invention and are not intended to be limiting. As will be apparent from the following description of embodiments, a perforating gun assembly according to the present invention can be installed upside-down, relative to the directions used in the description, and will function properly.

Figure 1A:
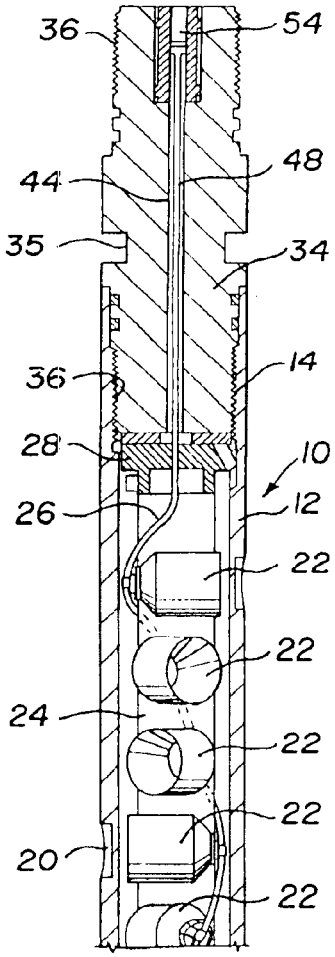
Fig. 1A (PRIOR ART)
FIGS. 1A and 1B together provide a longitudinal cross-sectional view of a typical perforating gun assembly according to the prior art.
Figure 1B:
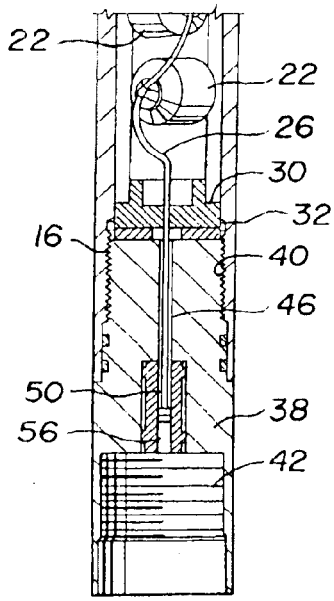
Fig. 1B (PRIOR ART)
Figure 2A:
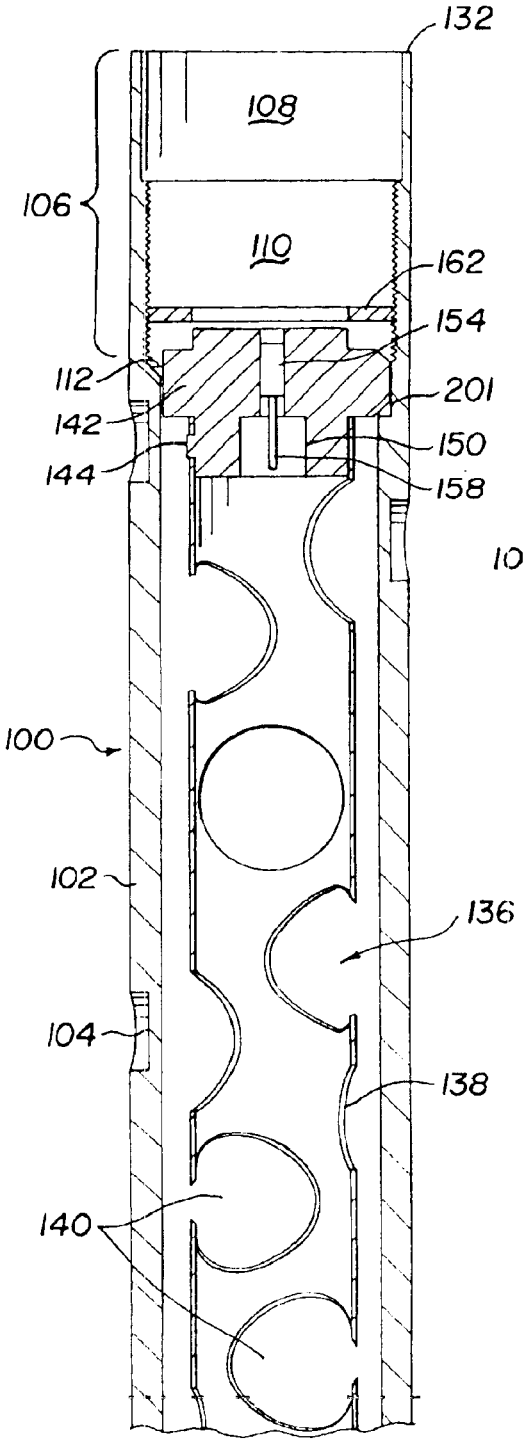
FIGS. 2A and 2B together provide a longitudinal cross-sectional view of a perforating gun assembly according to the present invention.
Figure 2B:
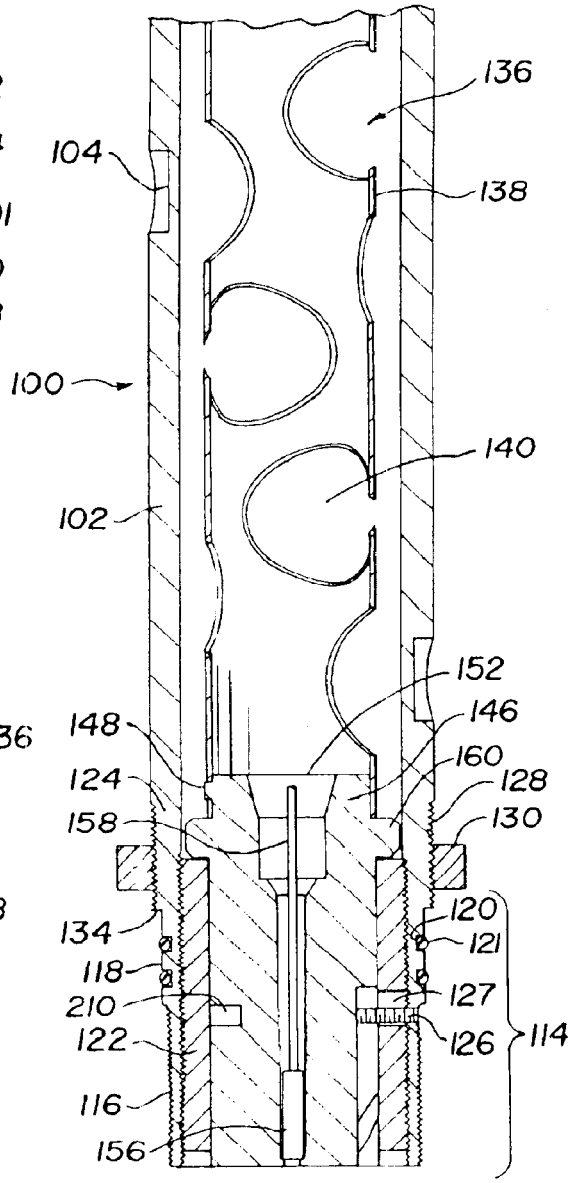

FIGS. 2A and 2B provide a cross sectional view of a perforating gun assembly 100 according to the present invention. Details of individual parts are described with reference to FIGS. 3 through 8 below. The main mechanical structure of the assembly 100 comprises a hollow steel carrier 102 made from a length of straight wall tubing, preferably high strength steel. The present invention is in part based on use of conventional straight wall tubing typically having a wall thickness of from about one-quarter inch to about five-eighth inch. This is conventional sized tubing, sections or joints of which may be coupled together to form work strings and which may be used to make carrier 12 of the prior art perforating gun assembly shown in FIGS. 1A and 1B. Tubing with greater wall thickness would have greater load bearing capacity, but is generally not preferred for use as perforating gun carriers, primarily because of reduced interior space which is needed for the shaped charges. That is, if special heavy walled tubing is used to obtain greater load bearing capacity, the shaped charge size will normally have to be reduced, which is not desirable. A helical pattern of gun ports, or scallops, 104 are cut into the outer surface of carrier 102.

In FIG. 2A is shown the upper end of carrier 102, on which a female or box coupling 106 has been formed on the inner surface of the carrier 102. Coupling 106 includes at its uppermost end a smooth bore section 108. Below the smooth bore section 108 is a threaded section 110. The threaded section ends at a shoulder 112 having the original carrier 102 inner diameter. The inner diameter of the threaded section 110 is greater than the inner diameter of the smooth bore section 108, but less than the original carrier 102 inner diameter. The internal elements 108 and 110 are sized and shaped essentially like the internal shape of a female threaded end of a typical prior art perforating gun coupling such as couplings 14 and 16 of FIGS. 1A and 1B.

In FIG. 2B is shown the lower end of carrier 102, on which a male or pin coupling 114 has been formed on the outer surface of carrier 102. Coupling 114 includes on its lowermost end an externally threaded section 116, sized to mate with threaded section 110 of the upper end female coupling 106. Above threaded section 116 is a generally smooth outer section 118, having a diameter greater than the threaded section 116 and sized to fit within the smooth bore section 108 of the upper end female coupling 106. The diameter of section 116 is less than the original outer diameter of the carrier 102. One or more seal ring grooves 120 are formed in this smooth outer section 118. Sealing rings 121, e.g. O-rings, are carried in the grooves 120. The external elements 116, 118 and 120 are sized and shaped essentially like the external shape of a male threaded end of a typical prior art connector such as connectors 34 or 38 of FIGS. 1A and 1B. They will therefore form a fluid sealed mechanical connection with female threaded ends of gun assemblies 100.

Cutting threads into the walls of tubing to form the upper and lower couplings 106 and 114 reduces wall thickness and therefore reduces the load bearing strength of the tubing. The strength reduction is greater for male couplings due to the reduction in outside diameter needed to mate with female couplings. Large diameter straight walled tubing used to make the carrier 102 for larger sized perforating guns typically has a wall thickness of about one-half inch. The strength of a male coupling formed in tubing of about one-half inch wall thickness will be sufficient for some, but not all perforating operations. For smaller diameter perforating guns, straight walled tubing used to make the carrier 102 typically has a wall thickness of only three-eighth inch. The strength of a male coupling formed in tubing of about three-eighth inch wall thickness will normally not be sufficient for perforating operations. Therefore, for most smaller diameter guns and many large diameter guns, it is preferred to strengthen the male threaded end.

As illustrated in FIG. 2B, an internal sleeve 122 has been inserted inside the lower end of carrier 102. The sleeve 122 has a length greater than the combined length of external threaded section 116 and the smooth section 118. It therefore extends into a portion 124 of carrier 102 having greater wall thickness than the sections 116 and 118. It is preferred that the sleeve 122 be at least long enough to extend into the smooth section 118 where the wall thickness is greater than in the threaded section 116 and more preferred that it extend into the portion 124 of maximum wall thickness. The sleeve 122 is externally threaded along its entire length. The lower end of carrier 102 is internally threaded along an equal length. The sleeve 122 is coupled to the internal surface of carrier 102 by these complementary threads, preferably acme threads. With the sleeve 122 thus threaded into the carrier 102, the completed male threaded end 114 has more than sufficient mechanical strength for coupling the gun assembly 100 into a work string for use in a borehole.

An alignment pin 126 is positioned through the threaded section 116 of carrier 102 lower end, extending through a slot 127 in sleeve 122 and into the interior of sleeve 122. In a preferred form, the pin is a setscrew threaded into a threaded hole in carrier 102. The pin 126 prevents rotation of sleeve 122 and provides an alignment means for a charge holder tube alignment fixture.

FIG. 2B also illustrates two optional, but preferred, elements on the lower end of carrier 102. An external thread 128, preferably reverse, is cut into the outer surface of carrier 102 just above the smooth portion 118. An internally threaded ring 130 is shown threaded onto the threads 128. The ring 130 may have any desired outer diameter and shape to act as a centralizer if desired. If a centralizer is not desired, the ring 130 may have an outer diameter essentially the same as the outer diameter of carrier 102. In any case, the ring 130 may be used as an orientation adjustment and locking means when multiple guns 100 are coupled together. It is often desirable that the scallops 104 of adjacent guns be aligned or otherwise positioned in a predetermined way relative to each other. If one gun carrier 100 is threaded onto another until the upper edge 132 of the carrier 102 abuts a shoulder 134 at the upper end of smooth section 118, the desired orientation may not be achieved. With the thread 128 and sleeve 130, the adjacent guns 100 may be unthreaded from the fully threaded position until the proper alignment is achieved. Then the ring 130 may be tightened against the end 132 of the lower gun to lock the guns in the desire position. The preferred reverse thread 128 helps ensure that the locked joint does not accidentally loosen during handling.

The above description of the FIGS. 2A and 2B embodiment covers the main load bearing structure of the gun assembly 100. This structure carries the mechanical loads required to assemble guns 100 into a work string and place them in a borehole. It also provides a convenient internal space for safely carrying a charge assembly which may be installed easily and quickly in accordance with the present invention.

With further reference to FIGS. 2A and 2B, a charge holder assembly 136 and its location within carrier 102 will be described. The charge assembly 136 is assembled primarily on a charge holder tube 138 having spaces 140 for holding a plurality of shaped charges in a manner as shown in FIGS. 1A and 1B. See also FIG. 7 for a perspective view of one end of the charge holder tube 138 with shaped charges 141 installed. The charge holder tube 138 is formed of lightweight metal, plastic, etc. as used in prior art devices. At its upper end, the charge holder tube 138 is coupled to an upper alignment fixture 142, preferably by two pins 144 and J-slots in the charge holder tube 138, see FIG. 7. At its lower end, the charge holder tube 138 is coupled to a lower alignment fixture 146, preferably by two pins 148 and J-slots in the charge holder tube 138. Alignment fixtures 142 and 146 have internal passageways 150 and 152 for receiving booster charges 154 and 156 connected to the ends of detonating cord 158 which is explosively coupled to each of the shaped charges 141 in charge holder 138. As explained in more detail below, the charge assembly 136 is retained in carrier 102 at its lower end by abutment of a shoulder 160 on lower alignment fixture 146 against the upper end of sleeve 122. An optional externally threaded ring 162 may be threaded into upper coupling thread 110 to abut the upper alignment fixture 142 and positively retain the charge assembly 136 in carrier 102.

Individual components shown in FIGS. 2A and 2B will be described with reference to FIGS. 3–8. The same reference numbers will be used to identify the parts which are identified in FIGS. 2A and 2B.

Figure 3:
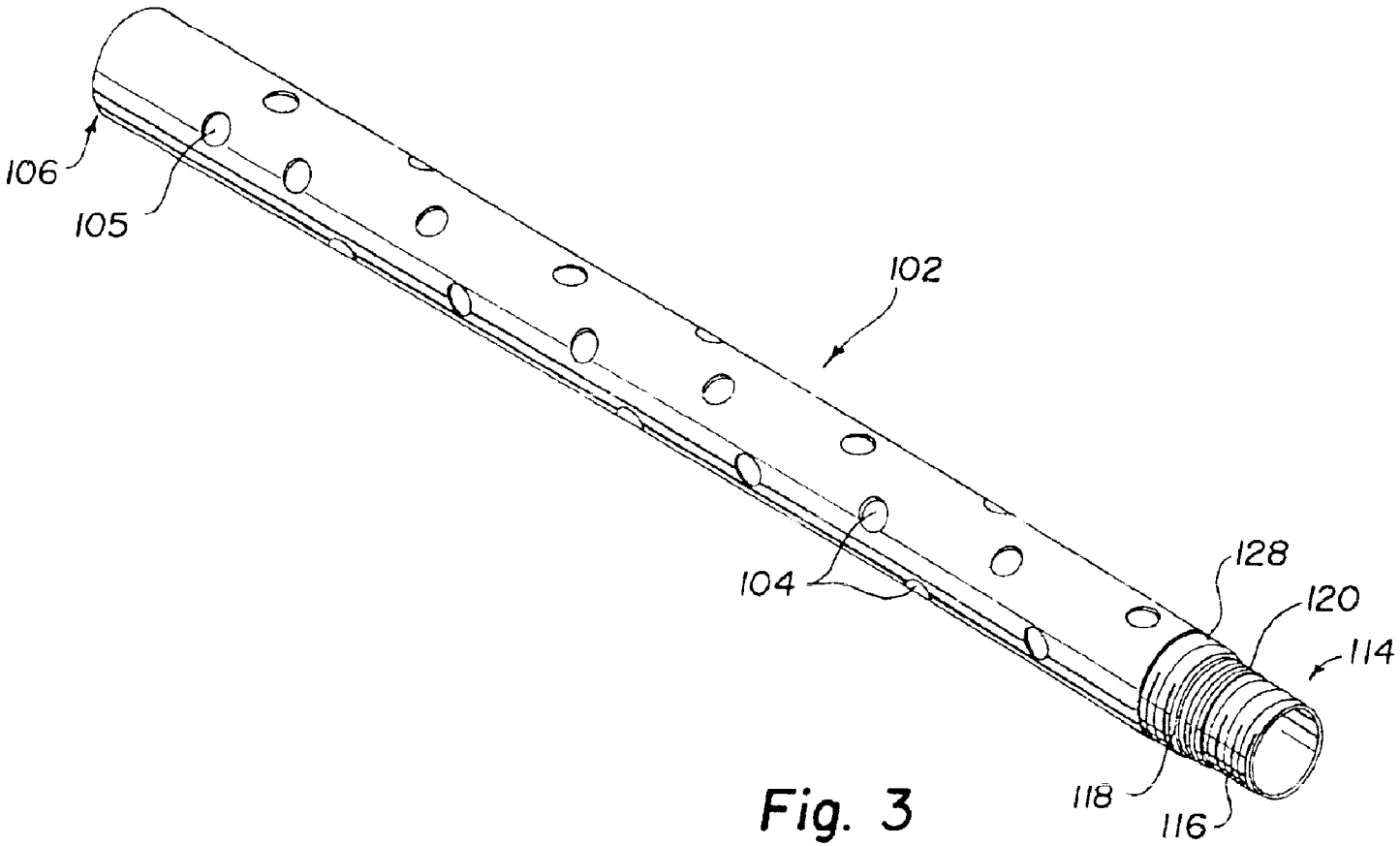
FIG. 3 is a perspective view of a perforating gun hollow steel carrier according to the present invention.

FIG. 3 provides a perspective view of the hollow steel carrier 102. The helical pattern of gun ports 104 is clearly seen in this view. An additional scallop 105 is illustrated on the upper end of carrier 102. The scallop 105 and two more scallops 105 not seen in this view are not aligned with perforating charges in this embodiment. The three scallops 105 are positioned at the same axial location near the upper end of carrier 102 and spaced radially by about 120 degrees relative to each other. These three scallops 105 are used as a means for gripping the carrier 102 during lifting and assembly of the gun assembly 100 into a work string. While three lifting scallops 105 are used in this embodiment, it is desirable to have at least two handling scallops 105 on opposite sides of the carrier 102. While none of the lifting scallops 105 in this embodiment are aligned with shaped charges, at least one of the lifting scallops 105 may be aligned with a shaped charge if desired. Other lifting means, such as the annular groove 35 shown on tandem connector 34 of FIG. 1A may be used if desired. However, the use of lifting scallops 105 is preferred because it may have less affect on strength of carrier 102 than an annular groove would have.

Figure 4:
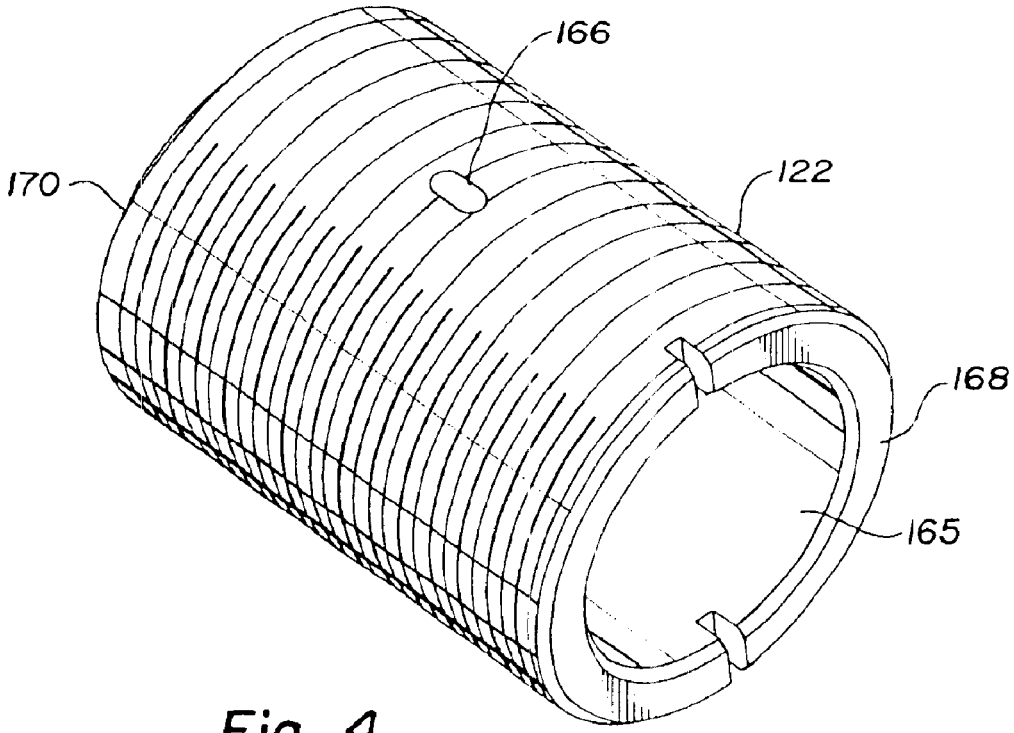
FIG. 4 is a perspective view of a reinforcing sleeve according to the present invention.

FIG. 4 provides a perspective view of the reinforcing sleeve 122 forming part of the lower male coupling 114 of FIG. 2B. It is basically a simple hollow cylinder, preferably made of high strength steel. The outer surface 164 of the sleeve 122 is threaded over its entire length. The inner surface 165 may be smooth. An elongated aperture 166 extends from the outer surface 164 through to the inner surface 165 of the sleeve 122. The aperture 166 is positioned so that when the sleeve 122 is threaded into carrier 102 until its lower end 168 is about flush with the lower end of carrier 102, the aperture 166 is aligned with the alignment pin 126, FIG. 2. The upper end 170 of the sleeve 122 is preferably beveled on its interior edge to aid insertion of lower alignment fixture 146 as discussed below.

Figure 5:
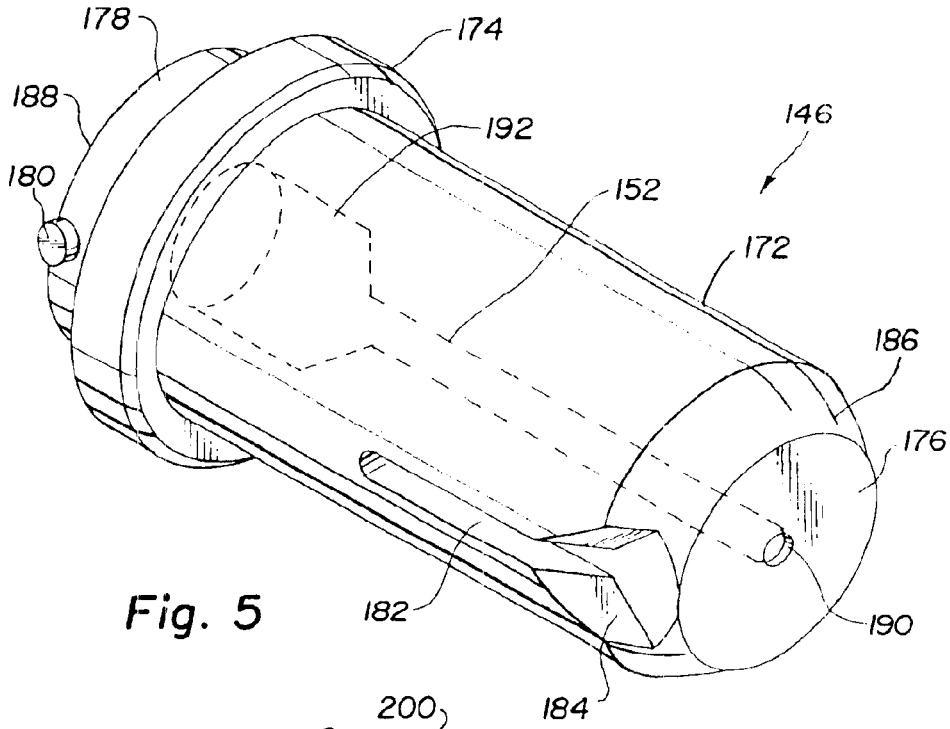
FIG. 5 is a perspective view of a lower charge holder tube alignment fixture according to the present invention.

FIG. 5 provides a perspective view of the lower alignment fixture 146. Alignment fixture 146 includes a lower end cylindrical section 172 sized to easily fit within the sleeve 122 as shown in FIG. 2. This section 172 has about the same length as the sleeve 122. A shoulder 174 at the upper end of section 172 having a diameter greater than section 172, is sized to fit within carrier 102 and to abut the upper end of sleeve 122. In this position, the lower end 176 of alignment fixture 146 is about flush with the lower end 168 of sleeve 122 and the lower end of carrier 102. The uppermost end of alignment fixture 146 is a second cylindrical section 178 for attachment to the charge holder tube 138. In this embodiment, the section 178 is cylindrical with a diameter sized to fit within the charge holder tube 138. A pair of pins 180, only one of which is visible in FIG. 5, extend radially from section 178 to form a type of bayonet connection with charge holder tube 138. The two pins 180 are generally on opposite sides of the section 178, but are preferably not spaced by exactly 180 degrees. In this embodiment a fifteen degree offset was intentionally made. The pins 180 engage a pair of J-slots in the charge holder tube 138, see FIG. 7. The uneven spacing ensures that the alignment fixture 146 can be attached to charge holder tube 138 in only one orientation so that proper alignment of charges 141 is made.

A longitudinal alignment slot 182 is formed in the outer surface of lower alignment fixture 146 lower section 172. The slot is expanded to a funnel or V-shaped opening 184 at its lower end. The lower edge 186 of section 172 is also tapered or beveled. These tapers and bevels aid assembly of the charge assembly 136 in the carrier 102. The slot 182 is sized to slide over the inner end of the alignment pin 126 as shown in FIG. 2. As noted above, the upper end of sleeve 122 preferably has an inner bevel 170. When it is desired to install a charge assembly 136 in a carrier 102, the carrier 102 may be rotated until the alignment pin 126 is visible. The charge assembly 136 may then be rotated until the slot 182 is roughly in the same radial position as the pin 126. Exact alignment is not necessary. The beveled edges 186 and 184 will guide the alignment fixture 146 into proper position in sleeve 122 as the assembly 136 is slid into place.

The central passageway 152, also shown in FIG. 2, extends from the lower end 176 to the upper end 188 of lower alignment fixture 146. The passageway 152 has a diameter sized to accept a length of detonating cord 158 with a booster charge 156 attached to its lower end. The lowermost end of passageway 152 preferably has a slightly reduced diameter portion or interior facing flange 190 sized to prevent the booster charge 156 from extending beyond the end 176 of the alignment fixture 146, and therefore to prevent it from extending beyond the end of the carrier 102. It is preferred that an upper end portion 192 of passageway 152 be of enlarged diameter and have an internal thread. In some cases it may be desirable to add a retainer in expanded passageway 192 to ensure that the booster charge remains positioned against the flange 190.

Figure 6:
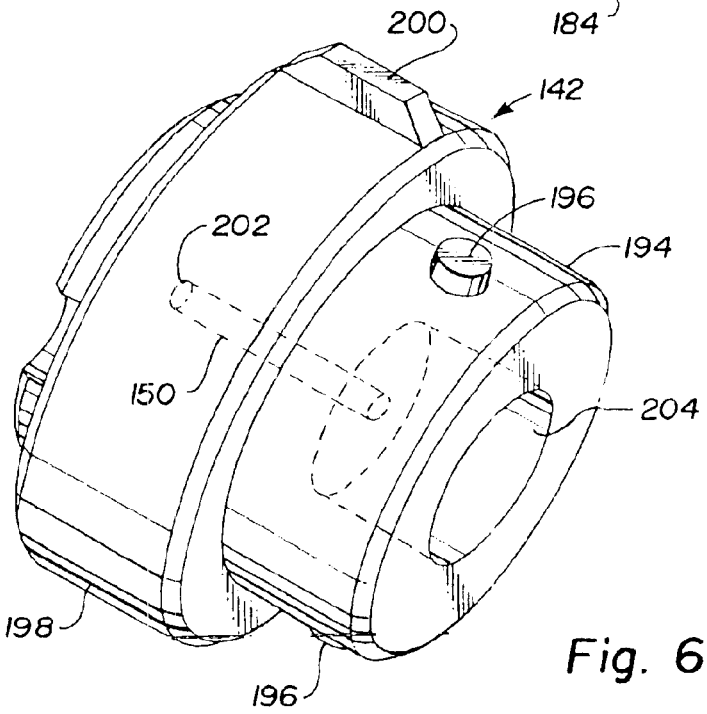
FIG. 6 is a perspective view of an upper charge holder tube alignment fixture according to the present invention.

FIG. 6 provides a perspective view of the upper alignment fixture 142. Upper alignment fixture 142 includes a lower cylindrical section 194 which may be essentially identical to the upper end 178 of lower alignment fixture 146. The section 194 carries two pins 196 asymmetrically spaced like the pins 180. Section 194 and pins 196 are sized and positioned to engage the upper end of charge holder tube 138 in the same way that the lower alignment fixture 146 engages the lower end of the charge holder tube 138, see FIG. 7. J-slots in the opposite ends of charge holder tube 138 are preferably facing in opposite directions so that turning the two alignment fixtures 142 and 146 at the same time tends to lock then to the charge holder tube 138. Above the section 194 is an enlarged cylindrical section or shoulder 198 having a diameter smaller than the original inner diameter of carrier 102. This section 198 also carries an alignment extension, e.g. a pin, lug or key, 200 on its outer surface adapted for sliding engagement with a slot 201 (see FIG. 2A) on the inner wall of carrier 102 below threaded portion 110. The alignment extension has an outer diameter less than the inner diameter of threaded section 110. In this embodiment, the slot 201 is radially aligned with the alignment pin 126 in the lower end of carrier 102. When alignment fixtures 142 and 146 are connected to the ends of charge holder tube 138, the lug 200 is aligned with the slot 182 in lower alignment fixture 146.

The internal passageway 150 in upper alignment fixture 142 is essentially a mirror image of the passageway 152 in the lower alignment fixture 146, though generally shorter. The passageway 150 preferably has a reduced diameter portion 202 at its upper end for preventing a booster charge 154 from extending from the upper end of alignment fixture 142. An enlarged diameter portion 204 may be provided on the lower end and may be threaded for receiving a retainer to hold a length of detonating cord and a booster charge in position in passageway 150 with the booster abutting the reduced diameter portion 202.

Figure 7:
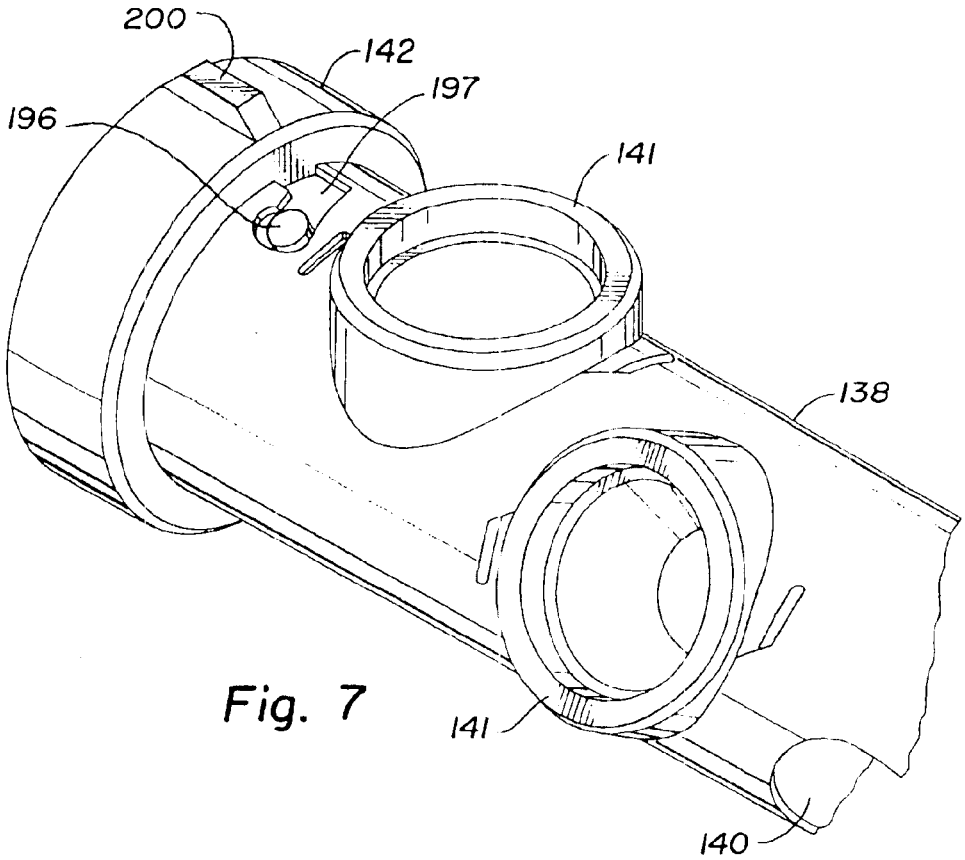
FIG. 7 is a perspective view of an upper alignment fixture illustrating its connection to a charge holder tube by means of a pin carried on the alignment fixture and a J-slot in the charge holder.

FIG. 7 provides a perspective view of the upper end of charge holder tube assembly 136 with upper alignment fixture 142 and two shaped charges 141 assembled. In this view, the engagement of pin 196 carried on upper alignment fixture 142 with a J-slot 197 is clearly seen. This view also shows an empty charge holder tube 138 space 140, illustrating the fact that in some cases not all available charge holder tube 138 charge locations 140 will be filled with shaped charges 141.

Figure 8:
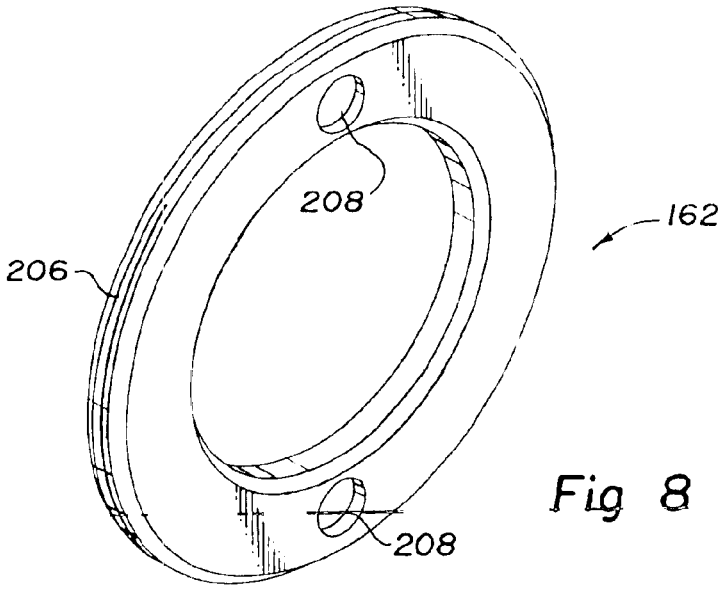
FIG. 8 is a perspective view of an upper end retainer ring according to the present invention.

FIG. 8 provides a perspective view of the retainer ring 162 shown in FIG. 2A. The retainer 162 is a washer shaped part having a outer circumference 206 threaded to mate with the threaded section 110 in the upper female coupling 106, see FIG. 2A. A pair of holes 208 may be provided through ring 162 to provide a means for tightening the ring 162 against the upper charge holder alignment fixture 142.

It is apparent that the charge holder tube assembly 136 including charge holder tube 138, alignment fixtures 142 and 146 and the retainer ring 162 are not exposed to the mechanical forces present in the work string and therefore in carrier 102. Instead, the charge holder assembly 136 must simply support itself primarily by resting on the top of reinforcing sleeve 122. As a result, it is not necessary to make the charge holder components out of high strength materials. The alignment fixtures 142 and 146 may be made of various metals such as aluminum or zinc, or plastic materials such as Bakelite. These materials allow the parts to be cast or molded rather than machined, thereby reducing manufacturing costs. At the current time, the alignment fixtures 142 and 146 will preferably be made of aluminum based on cost factors.

As noted above, the alignment fixtures 142 and 146 are preferably made of materials which can be cast or molded. In the casting or molding process, the alignment pins 180 and 196 may be cast or molded from the same materials or may be separate parts placed in the molds and bonded to the alignment fixtures in the casting or molding process. The pins 180 and 196 could be replaced with threaded pins or screws in tapped holes in the alignment fixtures 142 and 146 if desired. The J-slots in the charge holder 138 could be replaced with simple holes through which the threaded fasteners could be inserted and fastened to the alignment fixtures 142 and 146. However, the simple pin and J-slot arrangement of the present invention is preferred because it is believed to be cheaper to make and much easier to assemble in the field.

With reference to FIGS. 2B, 4 and 5, it will be apparent that the alignment means of the disclosed embodiment may be modified or replaced with alternative alignment means. In this embodiment, the alignment pin 126 is threaded into carrier 102 and extends through aperture 166 in sleeve 122 and inside sleeve 122 by a sufficient distance to mate with groove 182 in lower alignment fixture 142. In one alternative, the alignment pin 126 may be shorter and engage only the aperture 166, which would not need to extend all the way through the sleeve 122. Separate alignment pins and slots may be provided to align the lower alignment fixture 146 with sleeve 122. For example, a separate pin may be attached to the inner surface 165 of sleeve 122 to mate with the slot 182 in lower alignment fixture 146. Or a slot may be formed on the inner surface of sleeve 122 and the slot 182 on lower alignment fixture 146 may be replaced with an extending pin, key or other shape to mate with the slot in sleeve 122. This alignment arrangement may be very similar to the alignment arrangement used with the upper alignment fixture 142 in the disclosed embodiment.

With reference to FIGS. 2B and 5, another alignment means is illustrated. An aperture or recess 210 is shown on the portion 172 of lower alignment fixture 146. The recess 210 is positioned opposite alignment slot 182. If desired, the alignment fixture 146 may be positioned with the recess 210 aligned with the pin 126, before the pin is inserted all the way into the carrier 102. The pin 126 may then be inserted into the recess 210 to lock the alignment fixture 146 into place. This alternate alignment means is provided primarily for the case where a charge holder tube 138 and charges 141 are not installed into a carrier 102. This can occur when a carrier 102 is used simply as a spacer between other gun assemblies 100 and includes only detonating cord 158 and booster charges 154 and 156, for explosive coupling between fully loaded gun assemblies. In this case it is also desirable to use a retainer in the passageway 192 to hold detonating cord 158 within the alignment fixture 146.

Assembly of a perforating gun according to the present invention is simple and requires less time and parts than prior art gun systems. Likewise assembly of a number of guns into a string of guns and into a work string in a borehole is simplified. A hollow steel carrier 102 of appropriate length is selected. The carriers 102 can be made in essentially any desired length, but may be made in "standard" lengths such as ten and twenty feet for stocking purposes. A reinforcing sleeve 122 is threaded into the lower end of the carrier 102 until the alignment aperture 166 is aligned with the alignment pin 126 in carrier 102. The alignment pin 126 is then threaded into carrier 102, through the sleeve 122 and partly into its interior. Seals, e.g. O-rings 121 are placed in the grooves 120 in the lower male coupling 114 to provide a fluid tight seal between adjacent gun assemblies 100.

A matching charge holder tube 138 is also selected. A desired number of perforating charges 141 are then selected and loaded into the charge holder tube 138. It is not necessary that all spaces 140 for charges 141 in the charge holder tube 138 actually be loaded with charges 141. A detonating cord is then run along and attached to each of the charges 141. At each end of the charge holder tube 138, a length of detonating cord is provided for insertion in the alignment fixtures 142 and 146. A booster charge is crimped onto each end of the detonating cord. The booster charges are inserted into the alignment fixtures 142 and 146 as the alignment fixtures are attached to each end of the charge holder tube 138 with the pins 180, 196 and J-slots 197.

The complete charge assembly 136 is then lowered into the carrier 102 from the upper end. Before the lower alignment fixture 146 is placed in the carrier 102, the alignment slot 182 is aligned radially with the position of alignment pin 126. This is conveniently done by rotating the carrier 102 until the pin 126 is facing upward and then turning the charge assembly until the slot 182 is likewise facing upward. The charge assembly may then be simply slid into the carrier 102. The tapered edges on lower alignment fixture 146 will correct for considerable misalignment as the lower alignment fixture engages the sleeve 122 and alignment pin 126. As that occurs, the lug 200 on the upper alignment fixture 142 should easily slide into the alignment slot 201. With both alignment fixtures properly aligned and thus prevented from rotation relative to the carrier 102 and each other, the charge assembly is locked into place by gravity so long as it is not turned over. To protect against this possibility, a retainer ring 162, FIGS. 2 and 7, may be threaded into the upper end of carrier 102 until it contacts the upper alignment fixture 142. With ring 162 in place, the completed perforating gun may be turned upside down and will remain assembled.

One or more completed gun assemblies 100 may be easily coupled together and into a work string. An assembly 100 may be gripped by the three lifting scallops 105 on its upper end for lifting and for applying torque to turn the assembly for threading to other components. As the string is assembled at the well head, the scallops 105 may also be used to hold a first gun 100 which has been partly lowered into the well head while another gun 100 or work string section is lifted and threaded onto the first gun.

Multiple guns may be directly threaded together to form a longer perforating gun assembly. As described above, the lower male coupling 114 of a gun assembly 100 is adapted to be directly threaded into the female coupling of another gun assembly 100. When this is done, the booster charges in adjacent alignment fixtures are aligned with each other and closely spaced. With reference to FIGS. 2, 5 and 6, it can be seen that when two gun assemblies 100 are connected, the explosive transfer passageway 152 in a lower alignment fixture 146 is positioned adjacent the explosive transfer passageway 150 in the upper alignment fixture 142 of the next lower gun assembly. As a result, the booster charges 154 and 156 are exposed to each other through the ends 190 and 202 of the explosive transfer passageways. If either adjacent gun assembly 100 is fired, it will transfer the ignition to the adjacent gun assembly and so on until all guns in the string have been fired.

As noted above, the gun assemblies 100 may have an outer reverse thread 128 above and adjacent to the lower coupling 114. If a centralizer is required on a given job, then a centralizing ring 130 of the desired diameter may be threaded onto thread 128. If a centralizer is not required, then a locking ring 130, effectively a centralizer of minimum outer diameter, may be threaded onto the thread 128. The ring 130 may be used to radially align gun ports 104 on adjacent gun assemblies 100. The adjacent guns may be threaded together as far as possible, and then unthreaded until the desired alignment of gun ports 104 is achieved. Then the ring 130 may be tightened against the lower gun 100 to lock the threaded joint in the aligned position. The preferred reverse thread 128 ensures that torque applied to the joint will not loosen the joint.

While the present invention has been illustrated and described with reference to particular embodiments, it is apparent that various parts may be replaced with equivalent parts and other changes may be made to the present invention within the scope of the invention as set forth in the following claims.

What we claim as our invention is:

1. A perforating gun comprising:

a carrier made from a section of straight wall tubing having a first end and a second end, a male coupling thread formed on the first end, and a female coupling thread formed on the second end, the male and female threads being complementary to each other;

an internal thread formed in the interior of the carrier on the first end; and a reinforcing sleeve having an external thread, complementary to the internal thread.

2. A perforating gun according to claim 1, wherein:

the male coupling thread has a first axial length;

the reinforcing sleeve and the internal tread have a second axial length greater than the first axial length; and the reinforcing sleeve is threaded into the first end of the carrier.

3. A perforating gun according to claim 2, further comprising:

a first alignment aperture through the carrier near the first end;

a second alignment aperture through the sleeve; and an alignment pin extending through said first and second alignment apertures and into an interior space within the carrier.

4. A perforating gun according to claim 3, further comprising:

a charge holder first alignment fixture having an alignment slot mating with the alignment pin when the alignment fixture is positioned in the first end of the carrier.

5. A perforating gun according to claim 4, wherein:

the first alignment fixture comprises a first section having an outer diameter smaller than an inner diameter of the sleeve; and the alignment slot is formed in the first section.

6. A perforating gun according to claim 5, wherein the first alignment fixture comprises a shoulder having an outer diameter greater than the inner diameter of the sleeve.

7. A perforating gun according to claim 6, wherein the first alignment fixture comprises a second section adapted for coupling to a charge holder tube.

8. A perforating gun according to claim 7, further comprising:

a charge holder tube having a coupling aperture on a first and; and a coupling pin carried on the first alignment fixture second section and positioned to engage the charge holder tube coupling aperture.

9. A perforating gun according to claim 8, wherein the coupling aperture comprises a J-slot adapted for releasable engagement with the coupling pin.

10. A perforating gun according to claim 8, further comprising:

a second alignment fixture having a first section having an outer diameter smaller than the inner diameter of the carrier; and having a second section adapted for coupling to the charge holder tube.

11. A perforating gun according to claim 10, wherein the charge holder tube has a coupling aperture on a second end, further comprising:

a coupling pin carried on the second alignment fixture second section and positioned to engage the charge holder tube second end coupling aperture.

12. A perforating gun according to claim 11, wherein the charge holder tube second end coupling aperture comprises a J-slot adapted for releasable engagement with the second alignment fixture coupling pin.

13. A perforating gun according to claim 10, further comprising:

an alignment extension carried on the second alignment fixture; and an alignment slot, complementary to the alignment extension, formed in an inner surface of the second end of the carrier.

14. A perforating gun according to claim 3, further comprising:

a charge holder second alignment fixture having a first section having an outer diameter smaller than the inner diameter of said carrier; and having a second section adapted for coupling to a charge holder tube.

15. A perforating gun according to claim 14, further comprising:

a charge holder tube having a coupling aperture on a second end; and a coupling pin carried on the second alignment fixture second section and positioned to engage the charge holder tube coupling aperture.

16. A perforating gun according to claim 15, wherein the coupling aperture comprises a J-slot adapted for releasable engagement with the coupling pin.

17. A perforating gun according to claim 14, further comprising:

an alignment extension carried on the second alignment fixture; and an alignment slot, complementary to the alignment extension, formed in an inner surface of the second end of the carrier.

18. A perforating gun according to claim 1, further comprising:

two perforating gun carriers, the first end of a first of the two carriers coupled to the second end of a second of the two carriers.

19. A perforating gun according to claim 1, wherein the carrier is made from straight wall tubing having a wall thickness of from about one-quarter inch to about five-eighth inch.

20. A perforating gun according to claim 1, wherein the carrier is made from straight wall tubing having a wall thickness of about three-eighth inch.

21. A perforating gun according to claim 1, wherein the carrier is made from straight wall tubing having a wall thickness of about one-half inch.

22. A perforating gun according to claim 1, further comprising:

lifting means on the outer surface of the tubing.

23. A perforating gun according to claim 22, wherein the lifting means comprises a plurality of scallops formed in the outer surface of the tubing.

24. A perforating gun comprising:

a carrier made from a section of straight wall tubing having a first end and a second end, a male thread formed on the first end, and a female thread formed on the second end, the male and female threads being complementary to each other; and a reverse thread formed on the outer surface of the carrier adjacent the male thread.

25. A perforating gun according to claim 24, further comprising:

a locking ring having an internal thread complementary to the reverse thread, the ring carried on the carrier reverse thread.

26. A perforating gun according to claim 25, wherein the locking ring has an outer diameter larger than the outer diameter of the carrier.

27. A perforating gun according to claim 26, wherein the locking ring outer diameter is selected to centralize the gun assembly in a borehole.

28. A perforating gun, comprising:

a carrier made from a section of straight wall tubing having a first end and a second end, a male coupling formed on the first end, and a female coupling formed on the second end, the male and female couplings being complementary to each other; and lifting means comprising a plurality of scallops formed in the outer surface of the tubing, wherein at least one of the scallops is in a position not adapted for alignment with a shaped charge carried in the carrier.

29. A perforating gun, comprising:

a charge holder tube having a first end and a second end;

a first alignment fixture having a first section having a diameter selected to slidably fit within the charge holder tube first end and having a longitudinal alignment slot over a portion of its outer circumference;

at least one pin carried on the first alignment fixture first section;

at least one aperture in the first end of the charge holder tube adapted for receiving the at least one pin;

a gun carrier having a first end and a second end; and an alignment pin carried in the carrier and extending into the interior of the carrier and adapted for mating with the first alignment fixture alignment slot.

30. A perforating gun according to claim 29, wherein the charge holder tube first end at least one aperture is a J-slot.

31. A perforating gun according to claim 29, further comprising:

a second alignment fixture having a first section having a diameter selected to slidably fit within the charge holder tube second end;

at least one pin carried on the second alignment fixture first section; and at least one aperture in the second end of the charge holder tube adapted for receiving the at least one pin.

32. A perforating gun according to claim 31, wherein the charge holder tube second end at least one aperture is a J-slot.

33. A perforating gun according to claim 31, wherein the second alignment fixture comprises a longitudinal alignment extension over a portion of its outer circumference.

34. A perforating gun according to claim 33, further comprising:

a gun carrier having a first end and a second end; and an alignment slot in an interior wall of the carrier adapted for mating with the second alignment fixture alignment extension.

35. A method for making a perforating gun, comprising:

making a perforating charge carrier by:

selecting a section of straight wall tubing suitable for use as a hydrocarbon well work string, the section of tubing having a first end and a second end;

forming a male coupling on the first end of the section of tubing;

forming a female coupling, complementary with the male coupling, on the second end of the section of tubing forming a thread on the interior surface of the first end of the section of tubing; and threading a sleeve having an exterior thread into the first end of the section of tubing.

36. A method for making a perforating gun according to claim 35, wherein:

the step of forming a male coupling comprises forming a thread on the outer surface of the first end of the section of tubing; and the step of forming a female coupling comprises forming a thread on the inner surface of the second end of the section of tubing.

37. A method for making a perforating gun according to claim 36, further comprising:

making a first and a second perforating charge carrier; and threading the male coupling of the first perforating charge carrier to the female coupling of the second perforating charge carrier.

38. A method for making a perforating gun according to claim 37, further comprising:

forming a reverse thread section on the first end of the first perforating charge carrier adjacent the male coupling;

threading a reverse threaded ring onto the reverse thread section; and tightening the ring against the female coupling of the second perforating charge carrier.

39. A method for making a perforating gun according to claim 38, further comprising:

before tightening the ring against the female coupling of the second perforating charge carrier, rotating the first and second perforating charge carriers relative to each other to achieve a desired relative radial position.

40. A method for making a perforating gun according to claim 35, wherein:

the interior thread on the first end of the section of tubing has a length greater than the length of the male coupling on the first end of the tubing and the sleeve has a length about equal to the length of the interior thread on the first end of the section of tubing.

41. A method for making a perforating gun according to claim 35, further comprising:

forming a first aperture through a wall of the section of tubing near the male coupling;

forming a second aperture through the sleeve, the first and second apertures positioned to be aligned when the sleeve is threaded into the tubing; and inserting an alignment pin through the first and second apertures to prevent relative rotation of the section of tubing and the sleeve.

42. A method for making a perforating gun according to claim 41, further comprising:

forming a longitudinal alignment slot in the inner surface of the second end of the section of tubing adjacent the female coupling.

43. A method for making a perforating gun according to claim 42, further comprising:

making a charge holder assembly by:

selecting a section of charge holder tube having an first end and a second end and adapted to be carried within the carrier;

forming a pair of coupling apertures in each of the first and second ends of the charge tube holder section;

making a first alignment fixture having a first end adapted to be carried within the sleeve, having a longitudinal alignment slot on the first end, having a pair of coupling pins on a second end adapted for mating with the first end of the charge holder tube, and having a shoulder between the first and second ends having an outer diameter greater than the inner diameter of the sleeve;

making second alignment fixture having a pair of coupling pins on a first end adapted for mating with the second end of the charge holder tube, and having an alignment extension adapted to mate with the longitudinal alignment slot in the inner surface of the second end of the section of tubing;

coupling the first alignment fixture to the first end of the charge holder tube using the first alignment fixture couplings pins and the charge holder tube first end coupling apertures; and coupling the second alignment fixture to the second end of the charge holder tube using the second alignment fixture couplings pins and the charge holder tube second end coupling apertures.

44. A method for making a perforating gun according to claim 43, wherein the coupling apertures in each of the first and second ends of the charge tube holder section comprise J-slots.

45. A method for making a perforating gun according to claim 43, wherein the alignment pin extends into the interior of the sleeve, further comprising:

inserting the charge holder assembly through the female coupling and into the carrier so that the first alignment fixture alignment slot mates with the alignment pin, the second alignment fixture alignment extension mates with the longitudinal alignment slot in the inner surface of the second end of the section of tubing adjacent the female coupling, and the first alignment fixture shoulder is adjacent the sleeve.

46. A method for making a perforating gun according to claim 45, further comprising inserting a retainer into the female coupling adjacent the second alignment fixture.

47. A method for making a perforating gun according to claim 35, further comprising:

making a first and a second perforating charge carrier; and connecting the male coupling of the first perforating charge carrier to the female coupling of the second perforating charge carrier.

48. A method for making a perforating gun according to claim 35, wherein the carrier is made from straight wall tubing having a wall thickness of from about one-quarter inch to about five-eighth inch.

49. A method for making a perforating gun according to claim 35, wherein the carrier is made from straight wall tubing having a wall thickness of about three-eighth inch.

50. A method for making a perforating gun according to claim 35, wherein the carrier is made from straight wall tubing having a wall thickness of about one-half inch.

* * * * *

UNITED STATES PATENT AND TRADEMARK OFFICE

CERTIFICATE OF CORRECTION

PATENT NO. : 6,851,471 B2
DATED : February 8, 2005
INVENTOR(S) : Barlow et al.

It is certified that error appears in the above-identified patent and that said Letters Patent is hereby corrected as shown below:

Column 11,
Line 11, replace "tread" with -- thread --
Line 44, replace "and;" with -- end; --

Signed and Sealed this

Seventeenth Day of May, 2005

JON W. DUDAS
*Director of the United States Patent and Trademark Office*